United States Patent [19]

Bolin

[11] 4,104,945

[45] Aug. 8, 1978

[54] SOUND RESONATOR FOR AMPLIFYING SOUND WAVES

[76] Inventor: Gustav Georg Arne Bolin, Renstiernas gata 12, 116 31 Stockholm, Sweden

[21] Appl. No.: 792,371

[22] Filed: Apr. 29, 1977

[30] Foreign Application Priority Data

May 13, 1976 [SE] Sweden ..... 7605470

[51] Int. Cl.[2] ..... G10H 3/00

[52] U.S. Cl. ..... 84/1.15; 84/189; 84/294

[58] Field of Search ..... 84/1.06, 1.15, 187, 84/189, 190, 191, 192, 193, 194, 195, 196, 270, 271, 294, 410

[56] References Cited

U.S. PATENT DOCUMENTS

| | | | |
|---|---|---|---|
| 3,668,295 | 6/1972 | Broussard | 84/1.15 |
| 4,050,341 | 9/1977 | Underwood | 84/1.15 |

*Primary Examiner*—Robert K. Schaefer
*Assistant Examiner*—Leonard W. Pojunas, Jr.
*Attorney, Agent, or Firm*—Dowell & Dowell

[57] ABSTRACT

A sound resonator apparatus including side walls and a sounding board the grain fiber of which is arranged from end to end of the resonator. A plurality of wooden strips are mounted on the exterior surface of the sounding board and substantially in parallel relationship with the grain thereof.

2 Claims, 3 Drawing Figures

SOUND RESONATOR FOR AMPLIFYING SOUND WAVES

BACKGROUND OF THE INVENTION

The present invention relates to a sound resonator for amplifying sound waves emanating from a sound source, especially a stringed instrument, in which the resonator has the shape of a box, the side walls of which are formed by a supporting frame and the bottom of which is a sounding board and into which is mounted an electromagnet composed of a coil and an armature. The armature is coupled to the sounding board and the coil is intended to be connected to an amplifier or a pressure-sensitive microphone, preferably of crystal type. A device of this type is known from e.g. applicant's Swedish Pat. No. 364,589, U.K. Pat. No. 1,408,895, and U.S. Pat. No. 3,908,503, according to which the sound resonator, also called soundboard, is intended to be used in connection with stringed instruments such as guitars, violins, pianos, etc., which are provided with soundboards, the soundboard of the sound resonator being tuned to that of the instrument in such a manner that the tunes emitted from the instrument are reproduced in amplified form while the beauty of the tune is maintained and even improved while simultaneously overtones are separated off.

SUMMARY OF THE INVENTION

The invention is embodied in a sound resonator having a sounding board and fixed on the external side of the sounding board, i.e. the side opposite the armature, are a plurality of strips with a mutual spacing increasing from one lateral edge of the board towards the opposite edge and that the board is made of wood with its grain fiber substantially coinciding wuth the longitudinal direction of the strips. The sound reproduction from the source emitting the sounds has proved to be so distinct and free from intermixing that even voices mixed with one another can be caught when broadcast.

One object of the invention is to provide a sound or tune resonator of this kind which can be combined to provide low weight and small dimensions so that is easily portable with capacity of reproducing the sound emitted from the mother instrument under even distribution and sound volume over the entire register in a manner extremely favorable for the total effect.

DESCRIPTION OF THE PREFERRED EMBODIMENT

Figure 1:
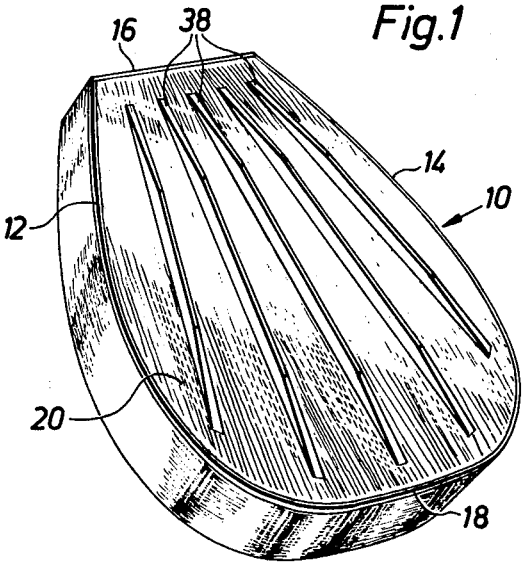
FIG. 1 is a bottom perspective view of the sound resonator of the present invention.
Figure 2:
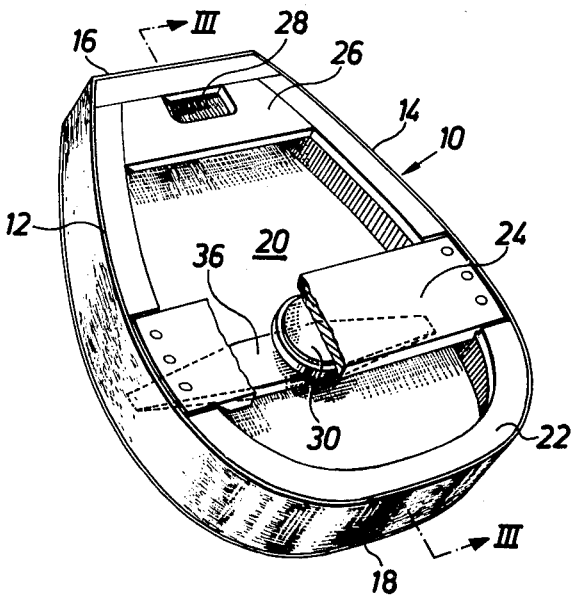
FIG. 2 is a top perspective view thereof.
Figure 3:
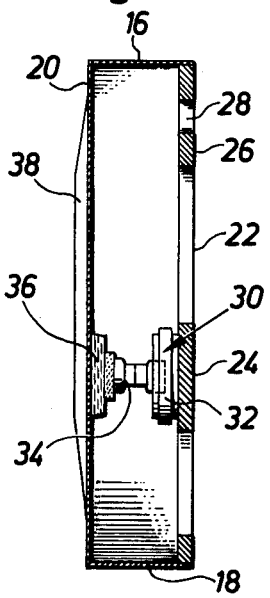
FIG. 3 is a section along the line III—III of FIG. 2.

In the shown embodiment the sound resonator has a frame 10 of pear-shaped contour with two side walls 12, 14 which diverge in a direction from the one end wall 16 towards the opposite end wall 18. The end wall 16 is plane whereas the end wall 18 merges into the long sides 12, 14 along a rounded curve. The frame constitutes the lateral walls of a box the bottom of which is formed by a thin board of wood which thus follows the contour of the frame and constitutes a sounding board. On the opposite side, the frame has a reinforcement 22 extending around the circumference thereof. In addition the frame is reinforced by a transverse girder or beam 24 located across the wide portion and a further beam 26 which is located at the narrower upper end of the resonator or soundboard and which may have a recess 28 serving as a handle.

Mounted in the interior of the box is an electromagnet 30 having a coil 32 mounted on the beam 24 and an armature 34 which bears against a central transverse, relatively strong strip or bridge 36 of wood which is secured onto the sounding board 20 by glue or other adhesive.

Fixed to the external side of the sounding board 20 is a number of strips 38, such as five strips, of wood which are adhered to the outer surface of the sounding board and diverge in a direction from the narrower end wall 16 towards the opposite end wall 18. The two outermost strips are mounted in parallel, or substantially parallel, relationship with the long sides 12, 14 of the frame. Furthermore, the grain fiber direction in the wooden board 20 is parallel, or substantially parallel, with the longitudinal direction of the strips 38, as is indicated in FIG. 1. The sounding board 20 may have a thickness of the order of magnitude of 5 mms, which may be reduced slightly from the central portion around the armature 34.

To mount strips diverging from one another on a sounding board is known per se from the above-mentioned Bitish and U.S. patents, but there they are located inside a box-shaped sound distributor. According to the present invention, positioning the strips on the outside of the resonator with their longitudinal direction coinciding with the direction of the grain fiber in the wooden board 20, provides an additional improvement of the effect which is basic for the constructions according to applicant's earlier patents. This holds true when the sound resonator of the present invention reproduces the harmonic sounds or tones emitted from the mother instrument and, in spite of the amplifier, retains the original tune and distribution over the tune register, and even becomes more enjoyable.

The sound resonator of the present invention can be manufactured with a substantially lower weight than was possible hitherto. Thus, the drawing, for example, represents an embodiment the weight of which was 2.5 kgs. only and which thus can be characterized as easily portable. The same advantage holds true for the dimensions thereof which render it possible for the sound resonator to be kept in a common case together with e.g. the guitar during transportation and storage.

In the use of the sound resonator or soundboard, the coil 32 of the electromagnet 30 is connected with the output from the sound amplifier of the mother instrument, e.g. the guitar, by means of a pressure-sensitive microphone of crystal type. In this connection it is not necessary that the microphone be applied below each string in the instrument, but, instead, a microphone in the shape of a unit can be connected with the cap of the instrument which carries the bridge for the strings.

I claim:

1. A sound resonator for amplifying sound waves emanating from a sound source comprising, side and end walls defining a frame, a wooden sounding board connected to one edge of said side and end walls and defining a box having an open side, said sounding board having internal and external surfaces and having grain fiber extending from one end wall to the opposite end wall so that the grain fiber is substantially parallel with said side walls, bridge means adhesively connected to said interior surface of said sounding board and extending substantially the full width thereof, a reinforcing beam extending across the open side of said box in spaced generally parallel relationship with said bridge, an electromagnet located between said bridge and said beam, said electromagnet including a coil attached to said beam and an armature connected to said bridge, said coil being connectable to a source of sound, and a plurality of wooden strips adhered to the external surface of said sounding board, said strips extending lengthwise of the grain fiber of said sounding board, said strips diverging slightly from each other and extending substantially from one end of said frame to substantially the opposite end thereof and being located in a position substantially normal to said bridge, the outermost strips substantially parallel with said side walls.

2. The structure of claim 1 in which said frame has substantially a pear-shaped configuration.

* * * * *